United States Patent [19]

Larrucea

[11] 4,089,536

[45] May 16, 1978

[54] WHEEL CARRIAGE ASSEMBLY

[76] Inventor: Henry Larrucea, 8532 Hamilton, Huntington Beach, Calif. 92648

[21] Appl. No.: 674,867

[22] Filed: Apr. 8, 1976

[51] Int. Cl.[2] ..... A63C 17/02

[52] U.S. Cl. ..... 280/11.28; 280/87.04 A

[58] Field of Search ..... 280/11.28, 87.04 A, 280/11.27, 11.26, 11.19

[56] References Cited

U.S. PATENT DOCUMENTS

| | | | |
|---|---|---|---|
| 321,466 | 7/1885 | Wall | 280/11.28 |
| 1,603,529 | 10/1926 | Faust | 280/11.28 X |
| 2,330,338 | 9/1943 | Dekome et al. | 280/11.28 |
| 2,537,213 | 1/1951 | De Vault | 280/11.28 |
| 3,751,062 | 8/1973 | White, Sr. | 280/87.04 A |

FOREIGN PATENT DOCUMENTS

| | | | |
|---|---|---|---|
| 963,581 | 5/1957 | Germany | 280/11.28 |

*Primary Examiner*—Joseph F. Peters, Jr.
*Assistant Examiner*—Milton L. Smith
*Attorney, Agent, or Firm*—Edward E. Roberts

[57] ABSTRACT

An improved wheel carriage or truck assembly for skateboards and the like. The wheel carriage comprises a pivot arm which carries an axle and wheels near one end thereof. The opposite end is mounted to the bottom of the board for pivotal movement against a shock absorber in a vertical plane which includes the axis of the shock absorber. The pivot arm is mounted for pivotal movement about its axis for pivoting the wheels in a horizontal plane against the biasing action of the shock absorber. This arrangement provides excellent shock absorption, while the vertical and horizontal pivotal movement components provide enhanced turning and banking capabilities and thereby improve responsiveness.

In a preferred embodiment, the axis of the pivot arm and the shock absorber intersect at an angle of approximately 90° to maximize shock absorption in the direction of motion. The angles at which the pivot arm and the shock absorber depend from the board can be varied to control turning and banking.

5 Claims, 7 Drawing Figures

FIG. 1.
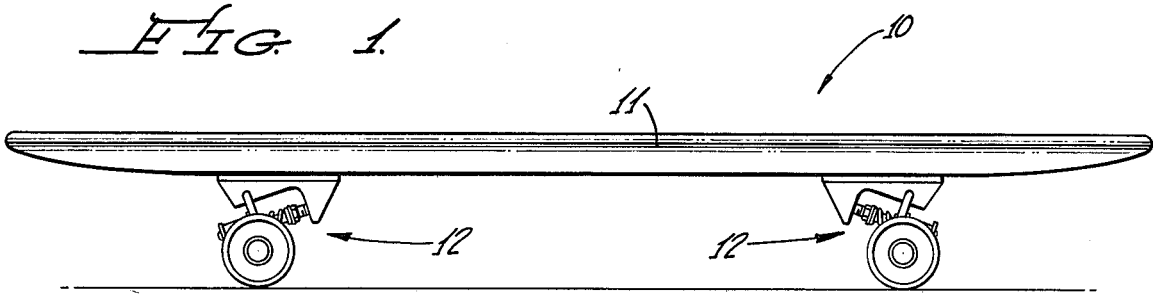
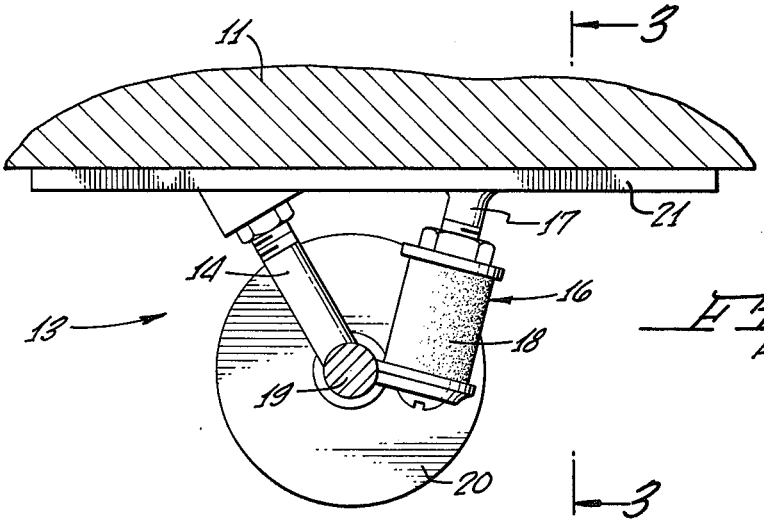
FIG. 2.
PRIOR ART
FIG. 3.
PRIOR ART
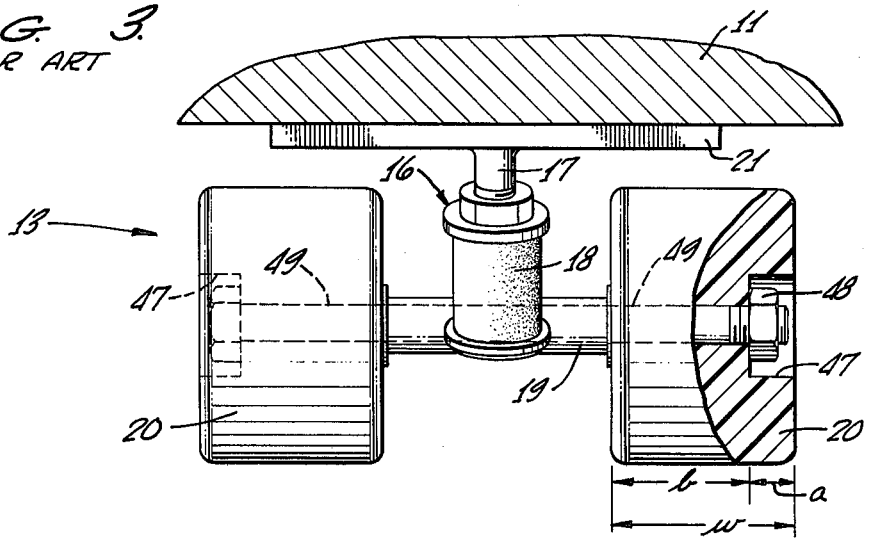

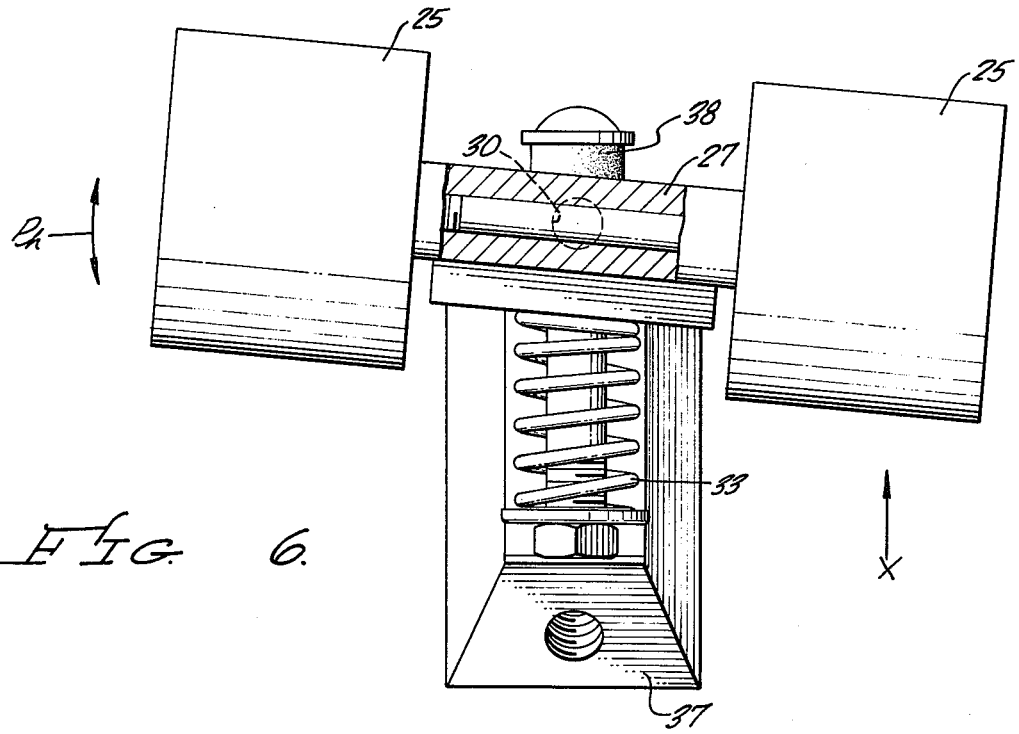
FIG. 6.
FIG. 7.
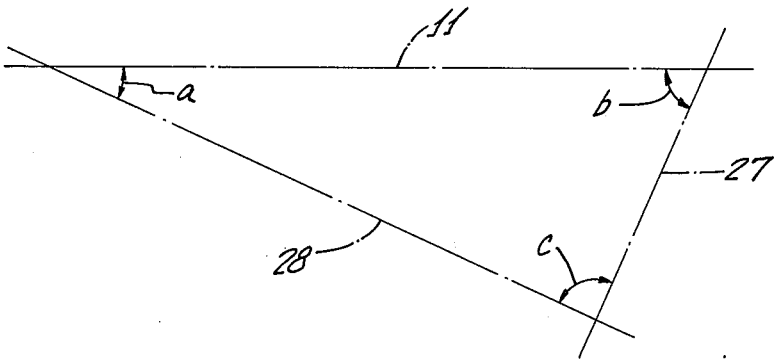

WHEEL CARRIAGE ASSEMBLY

BACKGROUND OF THE INVENTION

1. Field of the Invention

This invention relates to wheel carriage or truck assemblies and, more precisely, to a wheel carriage assembly for skateboards and the like which provides improved responsiveness during change of direction and improved shock absorption.

2. Description of the Prior Art

Typically, prior art trucks provide good rigidity and some rotational movement of the attached wheels in the horizontal direction, although rotation is limited because of the rigidity. Thus, e.g., when a skateboard rider (not shown in the drawings) leans into a turn, the wheels turn slightly in the horizontal direction. Consequently such trucks provide relative stability at the expense of responsiveness and smooth ride.

The shock absorption action provided by components such as the strut unit 16 in FIG. 2 is more effective in the vertical direction than the horizontal. At the least, the upright positioning of the strut unit 16 limits its effectiveness in ameliorating the effect of obstructions such as curbs and pavement dividers. This limited effectiveness is particularly unfortunate in view of the relatively small size of the wheels and their resulting susceptibility to obstructions such as curbs.

As will be thus appreciated, it is desirable to have a wheel carriage or truck assembly which provides improved responsiveness and also effective shock absorption in the direction of travel.

SUMMARY OF THE INVENTION

The present invention provides improved responsiveness and shock absorption for devices such as skateboards. The inventive wheel carriage assembly comprises a shock absorber which depends from the device at an acute angle; a pivot arm which also depends from the device at an acute angle and which is mounted for pivotal movement against the shock absorber both vertically along the shock absorber and also horizontally about its own axis; and wheels carried by the pivot arm. The angles between the shock absorber, the pivot arm and the device can be varied to control turning and banking and to optimize shock absorption for obstacles encountered by the wheels.

BRIEF DESCRIPTION OF THE DRAWINGS

FIG. 1 is a side view of a skateboard utilizing a wheel carriage assembly embodying principles of the present invention.

FIG. 2 is a side view of a wheel carriage assembly that is known in the art.

FIG. 3 is a front view, partially cut away, of the wheel carriage assembly of FIG. 2.

FIG. 6 is a bottom view, partially cut away, of the wheel carriage assembly of FIG. 1.

FIG. 7 is a schematic illustration of the angular relationships of the major components of the inventive wheel carriage assembly.

DETAILED DESCRIPTION

Figure 5:
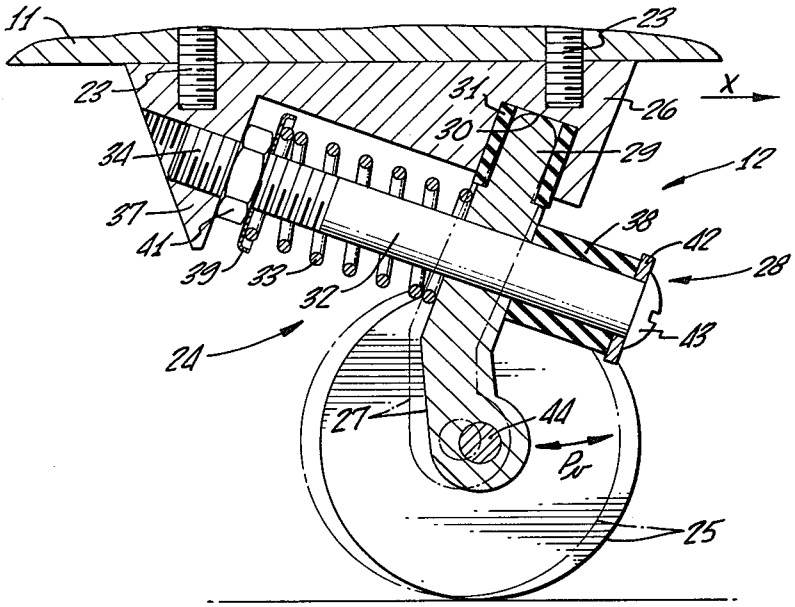
FIG. 5 is a cross-sectional representation, showing details of the wheel carriage assembly of the present invention.

Referring to FIG. 1, there is shown a skateboard 10 comprising a conventional board 11, which typically is of wood or plastic, and a pair of wheel carriage assemblies or truck assemblies 12—12. The assemblies 12—12 embody the principles of the present invention and are mounted toward opposite ends of the board 11.

A prior art wheel carriage 13 is shown in FIGS. 2 and 3. This assembly 13 comprises a strut 14 and a strut unit 16, which itself comprises a strut portion 17 and a rubber bushing 18. The strut 14 and the unit 16 intersect at an acute angle and there support an axle 19 and wheels 20—20. The strut 14 and unit 16 are mounted to a base plate 21, which is affixed to the board 11, and form a triangular-shaped structure with the base plate.

Two assemblies 13—13 are mounted toward opposite ends of a skateboard such as assemblies 12 on the board 11 (FIG. 1) with strut units 16—16 facing one another. The direction of travel of the board 11 is altered by shifting the rider's weight (not shown) to tilt the board. This causes the front and rear wheels 20—20 to pivot slightly in opposite directions in a generally horizontal plane to effect turning of the board 11.

The stability of the assembly 13 is relatively good. However, the assembly is rigid except for the bushing 18. Consequently, the responsiveness of the board is limited by the limited degree to which the wheels 20—20 can tilt and pivot. In addition, the upright rubber bushing 18 provides only a very small amount of shock absorption and practically none in the direction of travel. This is very important in view of the small size of the wheels 20—20 relative to normally-encounted obstacles such as pavement curbs, dividers, and stones.

Figure 4:
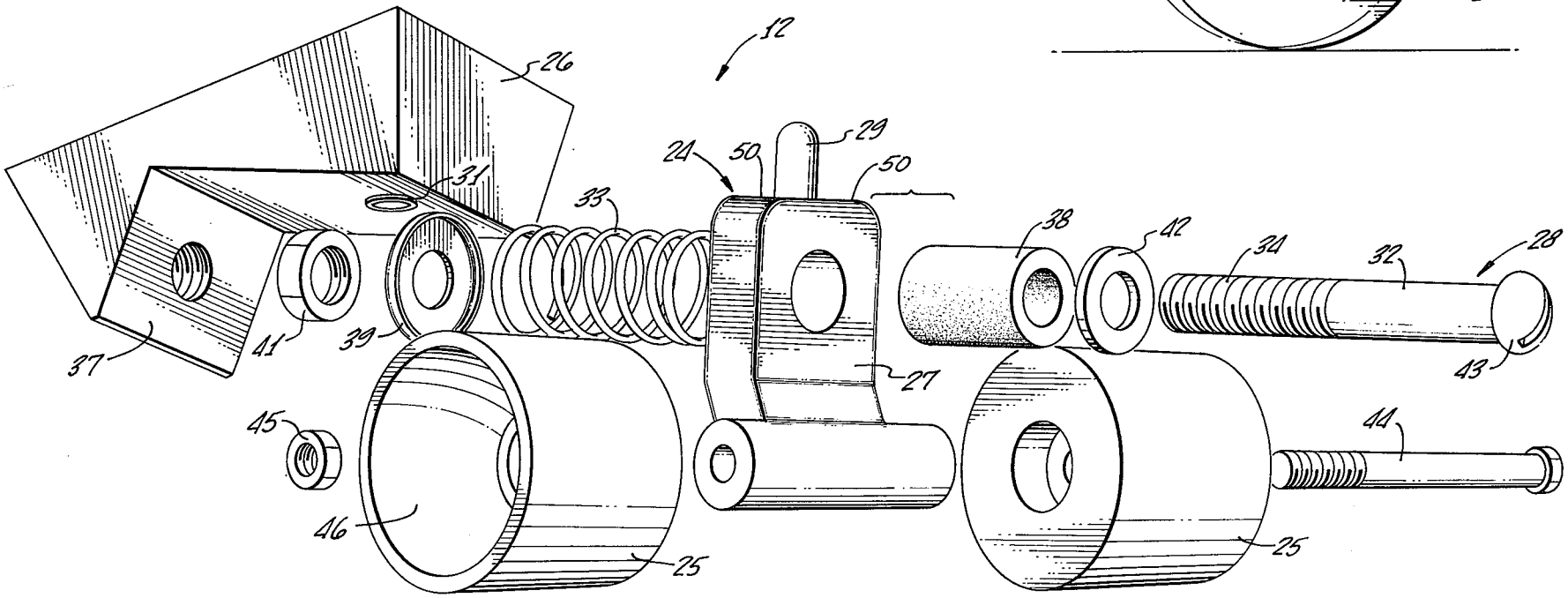
FIG. 4 is an exploded view of one of the wheel carriage assemblies shown in FIG. 1.

FIGS. 4 and 5 show, respectively, an exploded view and a side elevational cross section of the truck assembly or wheel carriage assembly 12 of the present invention. It will be appreciated that the invention is not limited to skateboards and can be applied to other motive devices, such as rollerskates. The exemplary assembly 12 comprises suspension assembly 24 and wheels 25—25. The suspension assembly 24 comprises a baseplate 26, typically wood or plastic, which can be affixed to the board 11 by any suitable means, such as screws 23—23, or can be formed or molded as part of the board.

The baseplate 26 mounts a pivot arm 27 and a shock absorber unit 28. The pivot arm 27 mounts an axle 44 which can be simple bolt 44 and nut 45 arrangement and which, in turn, mounts a pair of the wheels 25—25 at opposite ends thereof. As described in Applicant's copending U.S. application Ser. No. 674,868 which is hereby incorporated by reference, the stability and performance of the skateboard 10 is enhanced by wheels 25—25 which (1) are formed of material having a pronounced "memory", such as polyurethane, and (2) have a concave or dished profile.

The pivot arm 27 has a detent 29 which fits in bore 30 of the baseplate 26 for pivotal movement, $p_v$ (FIG. 5 only), in a vertical plane that includes the long axis of the board 11 and the axis of the shock absorber 28. A resilient, replaceable pivot cup 31 of material such as hard rubber can be used to protect the baseplate 26 and facilitate the pivotal movement $p_v$.

The pivot arm 27 is positioned within the aforementioned vertical plane by the shock absorber 28. The shock absorber comprises a bolt 32 carrying a helical spring 33. Typically, a first end 34 of the bolt is threaded or socketed to a flange 37 of the baseplate 26.

The pivot arm 27 is positioned within its vertical pivot plane by the spring 33, and resilient means 38 such as a rubber bushing. The spring 33 can be retained against one side of the pivot arm 27 by a spring retainer or washer 39 and an adjustment nut 41; the shock absorber pad 38 is positioned against the opposite side of pivot arm 27 by retainers or washer 42—42 and bolt head 43.

Referring now to the bottom view of the wheel carriage assembly 12 shown in FIG. 6, the pivot arm 27 can pivot in the bore 30 (shown dashed) in the horizontal or ground level plane against the resilient restraint provided by the spring 33 and the pad 38. This movement is illustrated by the arrow designated $p_h$ in FIG. 6. As mentioned previously, the pivot arm 27 can also pivot in the direction $p_v$ in a vertical plane which approximately parallels the direction of travel $x$. In combination, these different pivotal movements $p_h$ and $p_v$ pivot the axle and wheels 25—25 horizontally and bank the wheels toward the base 26. To illustrate, when a rider (not shown) shifts weight and/or leans to one side of the board, the wheels pivot, $p_h$, to turn the board in the horizontal direction of weight shift or lean. Then, as more force is applied via the shifting weight, the combination of $p_h$ and $p_v$ movement also banks the axle and wheels relative to the board 11. Consequently, the skateboard 10 is more responsive to the rider's weight shifting inputs than are prior art boards.

Referring now to FIG. 7, the angle $a$ between the board 11 and the shock absorber 28 axis and the angle $b$ between the board and the pivot arm 27 axis can be varied to control the turning and banking capabilities provided by the wheel carriage assembly 12. With both $a$ and $b$ set at 45°, turning and banking are balanced. By increasing angle $a$, and decreasing $b$, banking is enhanced at the expense of turning. Conversely, by increasing angle $b$ and decreasing $a$, turning capability is increased, while banking capability decreases. In practice, using $a$ and $b$ angles of 30° and 60°, respectively, has provided excellent turning capability and sufficient banking capability. Of course, these angles could be varied to change the operational characteristics as described above.

Varying angle $c$, the angle of intersection of the shock absorber 28 and pivot arm 27, affects the shock absorption action of the spring 33. With angle $c$ at 90°, the spring 33 is most efficient in dissipating shock forces along the shock absorber 28. In addition, with angle $a$ set relatively low, for example at 30°, the assembly 12 clears obstacles more easily and efficiently alleviates shock forces which approximate the direction of travel. This includes shocks from obstructions such as pavement dividers and edges.

Referring to FIG. 4, the pivot arm 27 has square shoulders 50—50 which are substantially parallel to the lower surface of the baseplate 26. These shoulders prevent the pivot pin from pivoting sideways in a vertical plane situated 90° to the straight line direction of travel $x$ aided by a bushing through the pivot arm (FIG. 5). The prior art wheel carriage assemblies typically prevent this sideways pivoting by using a shock absorber-pivot arm angle of less than 90°, but thereby lose shock absorption efficiency. As will be appreciated, the wheels 25—25 are relatively small, so that even small objects represent serious impediments to travel. For this reason, the effective shock absorption provided by the unique combination of spring, bolt and pivot arm is very desirable.

It will be appreciated that spring 33 could be replaced by a rubber bushing, that rubber bushing 38 could be replaced by a spring, and that the spring rates of either or both shock absorber springs could be varied to control the responsiveness or liveliness provided by the wheel carriage assembly 12. In general, a spring is preferable to rubber and the like for biasing component 38 because springs are livelier and snap back quickly and forcefully after compression, whereas resilient material tends to absorb shock and return more slowly (i.e., its motion is damped).

Thus, there has been described a carriage suspension which enhances the operation of skateboards and the like. The invention is limited only by the below-listed claims.

Having thus described a preferred embodiment, what is claimed is:

1. A wheel carriage assembly comprising:
   - a unitary baseplate having an upper plane surface securable to a footplate of a skateboard or the like;
   - shock absorber means, compressible along an axis thereof;
   - a pivot arm having first and second ends and including an angulated plate such that said first and second ends are displaced from a common plane, said baseplate having first means therein for receiving said first end of said pivot arm;
   - said first end including means adapted to permit pivotal movements of said pivot arm (1) about the axis of said pivot arm in a substantially horizontal plane and (2) along the axis of said shock absorber means in a substantially vertical plane, both of said pivotal movements being against the biasing action of said shock absorber means;
   - said second end comprising an axle mount;
   - an aperture located between said first end and the angulation in said angulated plate for receiving said shock absorber means whereby said shock absorber engages said pivot arm intermediate said first end and said angulation;
   - said shock absorber means including a shaft having first and second ends, said baseplate having second means therein for receiving said first end of said shaft, and first and second biasing means mounted, respectively, at the first and second ends of said shaft; and
   - said pivot arm being mounted on said shaft between said first and second biasing means for slidable movement along said shaft against the biasing of said first and second biasing means.

2. The wheel carriage assembly recited in claim 1 wherein;
   - said first end of said pivot arm includes substantially rectilinear shoulders and a detent which extends therefrom;
   - said shoulders extending substantially parallel to a lower surface of said baseplate and mounted substantially flush thereto to prevent said pivot arm from pivoting in substantially a vertical plane about said shock absorber shaft.

3. The wheel carriage assembly defined in claim 2, further comprising:
   - said pivot arm being normally positioned by said first and second biasing means at an angle approximately 90° relative to said shaft;

said pivot arm depending from said plane surface of said baseplate at an angle of approximately 60°; and said shaft depending from said plane surface of said baseplate at an angle of approximately 30°.

4. The wheel carriage assembly defined in claim 3, wherein said first biasing means at the first end of said shaft is a helical spring carried by said shaft, said shaft having means for adjusting the tension of said spring whereby the operational characteristics of said assembly are varied.

5. The wheel carriage assembly recited in claim 1 including;

axle means supported in said axle mount, and at least one wheel joined to and supported by said axle means.

* * * * *